US007699249B2

(12) United States Patent
Järvinen

(10) Patent No.: US 7,699,249 B2
(45) Date of Patent: Apr. 20, 2010

(54) METHOD FOR DEFINING THE DEGREE OF FULLNESS IN A MILL

(75) Inventor: Jussi Järvinen, Rauhalanpuisto (FI)

(73) Assignee: Outotec Oyj, Espoo (FI)

( * ) Notice: Subject to any disclaimer, the term of this patent is extended or adjusted under 35 U.S.C. 154(b) by 1147 days.

(21) Appl. No.: 10/542,058

(22) PCT Filed: Dec. 31, 2003

(86) PCT No.: PCT/FI03/00992

§ 371 (c)(1),
(2), (4) Date: Dec. 30, 2005

(87) PCT Pub. No.: WO2004/065014

PCT Pub. Date: Aug. 5, 2004

(65) Prior Publication Data

US 2006/0138258 A1 Jun. 29, 2006

(30) Foreign Application Priority Data

Jan. 17, 2003 (FI) ..... 20030078

(51) Int. Cl.
*B02C 25/00* (2006.01)

(52) U.S. Cl. ..... 241/30; 241/34

(58) Field of Classification Search ..... 241/30, 241/34

See application file for complete search history.

(56) References Cited

U.S. PATENT DOCUMENTS 3,779,469 A * 12/1973 Putman ..... 241/30
3,960,330 A * 6/1976 Henson ..... 241/30
4,123,009 A 10/1978 Kilpinen
4,294,412 A * 10/1981 Bohlin et al. ..... 241/30
4,635,858 A 1/1987 Welch et al.
4,722,485 A 2/1988 Young et al.
5,325,027 A 6/1994 Miettunen
5,360,174 A 11/1994 Persson
5,698,797 A 12/1997 Fontanille et al.
6,874,364 B1 * 4/2005 Campbell et al. ..... 73/593

FOREIGN PATENT DOCUMENTS

WO WO 01/03840 1/2001
WO WO 03043740 5/2003

OTHER PUBLICATIONS

Office Communication from related Australian Patent Application No. 2003290137 dated Dec. 11, 2008.

* cited by examiner

*Primary Examiner*—Bena Miller
(74) *Attorney, Agent, or Firm*—Brandon T. Schurter; Locke Lord Bissell + Liddell

(57) ABSTRACT

The invention relates to a method for defining the degree of fullness in a mill and the load toe angle ($\phi_k$), where there are used oscillations directed to the mill electric motor, in order to define the toe of the mill load composed of the mass to be ground. According to the invention, from the obtained measurements (P(n)) related to the mill draw or torque, there is defined the phase (θ) of the mill oscillation by using a frequency domain analysis, and that by means of the mill oscillation phase (θ), there is defined the load toe angle ($\phi_k$).

10 Claims, 1 Drawing Sheet

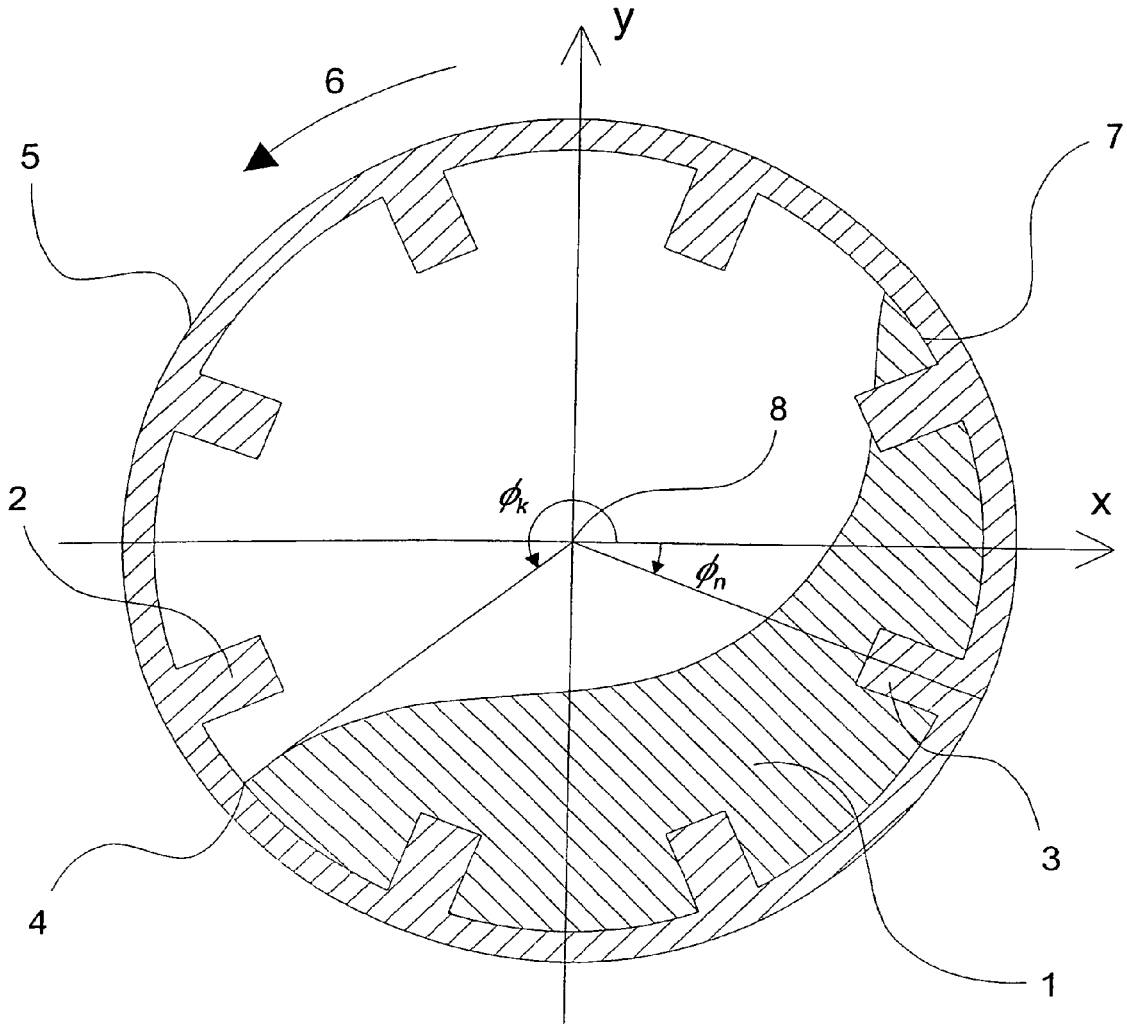
y
6
5
7
8
2
$\phi_k$
x
$\phi_n$
3
4
1

METHOD FOR DEFINING THE DEGREE OF FULLNESS IN A MILL

This application is the national phase application under 35 U.S.C. §371 of International Application No. PCT/FI2003/000992 filed on Dec. 31, 2003, entitled, "METHOD FOR DEFINING THE DEGREE OF FULLNESS IN A MILL" which claims the benefit of Finish Patent Application No. 20030078 filed on Jan. 17, 2003.

The present invention relates to a method for defining the degree of fullness in a mill and the toe angle of the mill load, which method uses frequency domain analysis of the oscillation occurring in the mill power draw or torque.

Autogenous and semi-autogenous grinding are processes that are difficult to control, because there the feed also acts as a grinding media, wherefore changes in the feed have a strong effect in the efficiency of the grinding. For example, as the feed hardness or particle size are reduced, the ore is not as effective as a grinding media, which has an effect in the efficiency of the whole grinding process.

Conventionally grinding has been controlled on the basis of the mill power draw, but particularly in autogenous and semi-autogenous grinding, the power draw is extremely sensitive to changing parameters. It has been discovered that the degree of fullness in the mill as percentages of the mill volume is a quantity that is remarkably more stabile and much more descriptive as regards the state of the mill. But because the degree of fullness is difficult to infer in an on-line-measurement, the measurement of the load mass is often considered sufficient. However, the mass measurement has its own problems both in installation and in measurement drift. Moreover, there may be intensive variations in the load density, in which case changes in the mass do not necessarily result from changes in the degree of fullness.

From the Fl patent 87114, there is known a method and device for measuring the degree of fullness in a mill, in which measurement there is made use of the changes related to the mill electric motor. According to said Fl patent 87114, in the measurement of the degree of fullness, there is used a standard-frequency power oscillation caused by the lifter bars of the mill housing and directed to the electric motor, so that in order to define the moment of impact between the mill housing lifter bars and the mass to be ground, there is measured the transition of the power oscillation peaks of the mill with respect to time. In order to synchronized the measurements outside the mill circumference, there is installed a measurement sensor, and on the mill circumference, there is installed a corresponding counterpiece. However, in order to function, the method according to the FI patent 87114 requires an essentially constant rotation velocity.

The object of the present invention is to eliminate some of the drawbacks of the prior art and to realize an improved method for determining the degree of fullness in a mill, which method uses the frequency domain analysis of the oscillation occurring in the mill and is independent of the rotation velocity. As an additional measurement, the method produces the toe angle of the mill load. The essential novel features of the invention are enlisted in the appended claims.

BRIEF DESCRIPTION Of THE DRAWING

FIG. 1 shows a rotation of a mill in a direction depicted by the arrow.

DETAILED DESCRIPTION OF THE INVENTION

The oscillation used in the method according to the invention, such as the oscillation related to the power or torque, is created as the mill lifter bars hit the load contained in the mill. When the mill rotates, the toe of the mill load, constituting the mass to be ground, on the mill circumference is shifted as the mill state, such as the degree of fullness or rotation velocity, changes, which means that also the oscillation phase is changed. In the frequency domain analysis of the oscillation, there is utilized the circular cross-section of the mill, so that there is drawn both a horizontal and a vertical axis via the center of the cross-section, and at the same time via the rotation axis of the mill. A coordinate system defined by means of the horizontal and vertical axes is used for measuring the changes that take place on the mill circumference. By means of a frequency domain analysis of the oscillation, the oscillation phase can be calculated. On the basis of the oscillation phase, there can further be calculated, in the cross-sectional coordinates, the toe angle of the mill load in relation to the horizontal axis in the cross-sectional coordinates of the mill.

According to the invention, advantageously for instance the frequency domain analysis of the power oscillation is carried out by means of the so-called Fourier transformation. When doing the frequency domain analysis, it is assumed that the power oscillation signal is for one complete cycle equidistant with respect to the angle of rotation of the mill. In case the mill speed of rotation is constant, the signal samples that are equidistant in relation to the angle of rotation are at the same time equidistant in relation to time. On the other hand, if the mill rotation speed fluctuates, signal samples measured at regular intervals are not equidistant in relation to the angle of rotation of the mill. In that case the frequency of the power oscillation changes continuously, and the frequency domain analysis of the power oscillation is not precise.

In order to make, according to the invention, the toe angle and the degree of fullness independent of the rotation speed, the speed fluctuations must be compensated in case there is used a power signal collected at a regular interval, and not the assumed signal, of which samples are equidistant in relation to the angle of rotation.

According to the invention, in order to compensate the speed of rotation of the mill, and in order to make the degree of fullness of the mill and the toe angle of the load independent of the fluctuations in the speed of rotation of the mill, there are collected samples at a constant sampling interval of 1-20 ms, and simultaneously there are collected, at the same constant sampling interval, samples of the angle of rotation of the mill. The angle of rotation of the mill is the angle in which the mill has turned/rotated around the mill rotation axis after the initial moment of the rotation cycle. Sensors that are suitable for measuring the angle of rotation of a mill are absolute angle sensors, as well as proximity sensors and distance sensors that detect the angle of rotation of the mill on the basis of the geometric shapes of the outer surface. In case the angle of rotation has not been measured for a given moment of sampling, the missing value of the angle of rotation can be calculated by interpolating from the measured values. Thus there is obtained, on the basis of the available values of power and angle of rotation, obtained at regular intervals, the function of power in relation to the angle of rotation. From this function, there can be calculated, by linear interpolation, sample data that is equidistant with respect to the angle of rotation, to be used in the frequency domain analysis of the power oscillation.

The invention is described in more detail below with reference to the appended drawing illustrating a cross-section of a mill, as well as a (x, y) coordinate system drawn in the cross-section, with an origin that is located on the rotation axis of the mill.

In the drawing, the rotation of the mill 5 takes place in a direction that is depicted by the arrow 6. On the mill rotation axis 8, there is installed a (x, y) coordinate system, by means of which the position of the mill load 1, located inside the mill and composed of the mass to be ground, is illustrated. When the mill 5 is in operation, it rotates in the direction 6 around the mill rotation axis 8, in which case the angle of rotation of the mill 5 grows during the rotation of the mill, starting from the initial moment of the rotation cycle, which in the drawing is described by the axis x in the (x, y) coordinate system. The mill load 1 moves along with the rotation, however so that the toe 4 between the wall 7 of the mill 5 and the load 1 remains essentially in place. The toe 4 remains essentially in place, because that part of the load 1 that is located topmost in the (x, y) coordinate system drops downwards, whereas that part of the load 1 that is located lowest in the (x, y) coordinate system rises up along the wall 7, towards the topmost part of the load. The position where the mill load 1 and the mill wall 7 encounter, that is the toe angle ϕk, is defined by means of the toe 4. Lifter bars connected to the mill wall 7, such as lifter bars 2 and 3, are used for lifting the load 1.

The phase θ of the power oscillation caused by the lifter bars is calculated by using a sample data P(n) that is equidistant in relation to the angle of rotation and is obtained on the basis of the mill power draw of one rotation cycle, according to the following formula (1):

$$\theta = \arg\left[\sum_{n=0}^{N-1} P(n)\exp\left(\frac{-2\pi i n N_n}{N}\right)\right] \tag{1}$$

where $i=\sqrt{-1}$=imaginary unit $$\arg z = \arctan\frac{\operatorname{Im} z}{\operatorname{Re} z} = \text{the polar angle,}$$

i.e. argument, of a complex number z,

N=number of samples in a sample data P(n), $N_n$ =number of lifter bars in the mill, n=number of sample, and θ=the phase of the oscillation caused by the lifter bars.

The toe angle is calculated from the phase θ of the power oscillation caused by the lifter bars as follows, according to the formula (2):

$$\phi_k = \frac{2\pi(k_n + 1) - \theta}{N_n} + \phi_n \tag{2}$$

where $k_n$=number of lifter bars, remaining in between the lifter bar 3 located nearest to the axis x and the lifter bar 2 located nearest to the toe 4, $\phi_k$=toe angle, and $\phi_n$=angle from the axis x to the lifter bar 3 located nearest to the axis x, so that it has a positive value in the rotation direction 6 of the mill.

The number $k_n$ of the lifter bars left between the lifter bars 2 and 3 is unknown, but because the toe angle is normally within the range 180-270 degrees, the angle $k_n$ can be restricted within the range (½$N_n$, ¾$N_n$). Thus the number of possible toe angle values $\phi_k$ is reduced, and further, because the number $k_n$ of the lifter bars left between the lifter bars 2 and 3 is always an integer, the number of possible values of the toe angle $\phi_k$ is only ¼$N_n$. Among these, the correct value is easily be selected, because the rest of the values describe extreme conditions that are unlikely.

The degree of fullness is calculated from the toe angle defined in formula (2) and the rotation speed of the mill by means of various mathematical models, such as the model defined in the Julius Kruttschitt Mineral Research Center (JKMRC). Said model is described in more detail for example in the book Napier-Munn, T., Morrell, S., Morrison, R., Kojovic, T.: Mineral Comminution Circuits, Their Operation and Optimisation (Julius Kruttschnitt Mineral Research Centre, University of Queensland, Indooroopilly, Australia, 1999). The calculation formula of the JKMRC model for the degree of fullness in a mill is given in the formula (3):

$$\begin{cases} n_{c,i+1} = 0{,}35(3{,}364 - V_i) \\ V_{i+1} = 1{,}2796 - \dfrac{\phi_{toe} - \dfrac{\pi}{2}}{2{,}5307(1 - e^{-19{,}42(n_{c,i+1} - n_p)})}, \end{cases} \tag{3}$$

where the degree of fullness is defined by iterating the degree of fullness of the mill in relation to the interior volume of the mill. In the formula (3), $n_c$ is an experimentally calculated portion of the critical speed of the mill, in which case centrifugation is complete, $n_p$ is the rotation speed of the mill in relation to the critical speed, $V_i$ is the previous degree of fullness of the mill, and $V_{i+1}$ is the degree of fullness to be defined, in relation to the interior volume of the mill.

The degree of fullness defined according to the invention can be used for instance when calculating a ball charge by means of various models describing the mill power draw, when also the mill power draw is taken into account. The accuracy of the ball charge can be further improved, when in the definition there is taken into account the mass and/or density of the mill load. In addition, the degree of fullness can also be used for adjusting, optimizing and controlling the mill and/or the grinding circuit, as well as for avoiding overload situations.

In the method according to the invention, the toe angle of the mill load, used when defining the degree of fullness, can also be utilized to control the mill, when the point of impact of the grinding media in the mill wall also is known. This point of impact can be calculated by means of various mathematical models describing the trajectories of the grinding media, which are affected, among others, by the mill rotation speed, the mill lining and the size of the grinding media. The grinding is most efficient when the grinding media hits the load toe, and therefore the rotation speed that optimizes the grinding efficiency can be calculated, when the point of impact and the toe angle are known.

The invention claimed is:

1. A method for defining the degree of fullness in a mill and a load toe angle ($\phi_k$) comprising, a) measuring oscillations occurring in the mill electric motor to define the toe of the mill load composed of the mass to be ground, b) obtaining measurements (P(n)), wherein a mill oscillation phase (θ) is defined by using a frequency domain analysis, and c) defining the degree of fullness in a mill and the load toe angle ($\phi_k$) by means of the mill oscillation phase (θ).

2. A method according to claim 1, wherein in the frequency domain analysis of the mill oscillation, there is used oscillation related to mill power draw.

3. A method according to claim 1, wherein in the frequency domain analysis of the mill oscillation, there is used oscillation related to mill torque.

4. A method according to claim 2, wherein the frequency domain analysis of the mill power oscillation is carried out by means of a Fourier transformation.

5. A method according to claim 1, wherein in order to make the degree of fullness of the mill and the load toe angle ($\phi_k$) independent of fluctuations in mill rotating speed, in each measurement there is measured the current angle of rotation of the mill, and by this measurement of the current angle of rotation, there are taken into account the speed fluctuations in the signal to be analyzed in frequency domain.

6. A method according to claim 1, wherein in the measurement of the angle of rotation, part of the angles of rotation of the mill are measured, and part are calculated from the measured angles by linear interpolation.

7. A method according to claim 1, wherein when defining the degree of fullness by means of the load toe angle, there is applied a mathematical model.

8. A method according to claim 1, wherein in both the power measurement used when defining the mill degree of fullness and the degree of fullness are utilized in order to calculate the ball charge of the mill.

9. A method according to claim 1, wherein the mill load toe angle used when defining the mill degree of fullness can be utilized in order to improve the grinding efficiency of the mill, when the point of impact of the grinding media is calculated by a mathematical model.

10. The method according to claim 7, wherein the mathematical model is a JKMRC model.

* * * * *